US009457400B2

(12) United States Patent
Fahrenbach et al.

(10) Patent No.: US 9,457,400 B2
(45) Date of Patent: Oct. 4, 2016

(54) CASTING VALVE WITH A POST-COMPRESSION PISTON

(71) Applicant: SCHULER PRESSEN GMBH, Goeppingen (DE)

(72) Inventors: Juergen Fahrenbach, Aichelberg (DE); Martin Gaebges, Albershausen (DE); Michael Richter, Birenbach (DE); Tobias Schwarz, Varel (DE)

(73) Assignee: SCHULER PRESSEN GMBH, Goeppingen (DE)

( * ) Notice: Subject to any disclaimer, the term of this patent is extended or adjusted under 35 U.S.C. 154(b) by 61 days.

(21) Appl. No.: 14/280,679

(22) Filed: May 19, 2014

(65) Prior Publication Data

US 2014/0345824 A1 Nov. 27, 2014

(30) Foreign Application Priority Data

May 27, 2013 (DE) ..... 10 2013 105 435

(51) Int. Cl.
*B22D 17/20* (2006.01)
*B22D 17/30* (2006.01)
*B22D 27/11* (2006.01)

(52) U.S. Cl.
CPC ..... *B22D 27/11* (2013.01); *B22D 17/20* (2013.01); *B22D 17/203* (2013.01); *B22D 17/2015* (2013.01); *B22D 17/2069* (2013.01); *B22D 17/2076* (2013.01); *B22D 17/30* (2013.01)

(58) Field of Classification Search
CPC B22C 9/08; B22D 17/2015; B22D 17/2023; B22D 17/2069; B22D 17/2076; B22D 17/22; B22D 17/30; B22D 17/20; B22D 27/11
USPC ..... 164/271, 284, 303, 304, 305, 306, 319, 164/320, 321, 120
See application file for complete search history.

(56) References Cited

U.S. PATENT DOCUMENTS

| | | | | |
|---|---|---|---|---|
| 4,860,818 | A * | 8/1989 | Dannoura | B22D 17/00 164/113 |
| 4,955,424 | A * | 9/1990 | Takehisa et al. | B22D 17/2007 164/113 |
| 6,105,658 | A | 8/2000 | Baumgartner | |
| 6,460,596 | B1 * | 10/2002 | Yamaguchi et al. | B22D 17/2007 164/113 |
| 2006/0042773 | A1 * | 3/2006 | Eisen | B22D 17/10 164/319 |
| 2012/0048498 | A1 * | 3/2012 | Inaba et al. | B22D 17/2007 164/254 |
| 2013/0233507 | A1 | 9/2013 | Müller | |

FOREIGN PATENT DOCUMENTS

| | | |
|---|---|---|
| DE | 1 847 509 U | 3/1962 |
| DE | 34 27 940 A1 | 2/1986 |
| DE | 195 08 867 A1 | 12/1995 |
| DE | 195 33 447 C1 | 12/1996 |

(Continued)

*Primary Examiner* — Kevin P Kerns
(74) *Attorney, Agent, or Firm* — Norman B. Thot

(57) ABSTRACT

A casting valve configured to supply a melt of a casting device includes a valve housing including a melt channel connection as an inlet and a valve outlet as a run-out. A melt channel is configured to be pressurizable via a casting pressure. A valve compartment is configured to receive the melt. The valve compartment is connectable via the melt channel connection with the melt channel. A closing device is configured to modify a cross-sectional surface of the valve outlet. A post-compression piston is configured to post-compress the melt after a completion of a mold filling.

6 Claims, 2 Drawing Sheets

(56) References Cited

FOREIGN PATENT DOCUMENTS

| | | | |
|---|---|---|---|
| DE | 100 01 088 A1 | 7/2001 | |
| DE | 10 2007 047 545 A1 | 4/2009 | |
| DE | 10 2011 050 149 A1 | 5/2012 | |

* cited by examiner

CASTING VALVE WITH A POST-COMPRESSION PISTON

CROSS REFERENCE TO PRIOR APPLICATIONS

Priority is claimed to German Patent Application No. DE 10 2013 105 435.8, filed May 27, 2013. The entire disclosure of said application is incorporated by reference herein.

FIELD

The present invention relates to a casting valve for feeding melts to a casting device with a valve housing that comprises a melt channel connection as an inlet and a valve outlet as a run-out, with a valve compartment for receiving the melt and with a closing means for modifying the cross-sectional area of the valve outlet. The present invention further relates to a casting device with such a casting valve and a casting method for manufacturing cast parts with this casting device.

BACKGROUND

Numerous measures to influence the filling process of mold cavities have previously been described in the prior art. Each type of melt has certain suitable gate velocities and gating systems. Since a maximal gate velocity must not be exceeded, it is necessary for the cross-section of the gate surface and thus for the part of the gating system that allows for separation of the sprue part from the die casting mold after the casting process to have sufficiently large dimensions. With extensive and thin-walled cast parts, this requirement leads to a great proportion of circulating material, the mass of which can lie in the range of the mass of the cast part itself. The circulating material is subsequently melted again, which requires a considerable supply of external energy.

In order to reduce the amount of circulating material, DE 10 2011 050 149 A1 describes arranging a casting valve in form of a pressure casting die directly on the gate area of the die casting mold. The casting valve is at first kept open by a resistance heating. Turning off the heating leads to the formation of a plug and thus to a closing of the casting valve. A controlled or temperature-independent closing of the valve is not possible. In order to be opened, the plug must be reliably melted, which lengthens the duration of the process and requires an overall higher energy supply per cast part due to temperature fluctuations.

Another, controllable, casting valve for metal melts is described in DE 34 27 940 A1. The melt portion is inductively supplied in a dosed manner by the casting valve and a shutoff occurs in conjunction with spatial limitation elements.

DE 10 2007 047 545 A1 describes a casting valve that is closable by means of a piston. The piston is axially displaceable in a valve housing. In order for concentricity errors of the piston to not lead to inhomogeneous melt streams and to provide a reliable closing of the casting valve, the piston-skirt surface forms a greater angle relative to the main axis of the valve than the valve housing in the run-out area. The piston forms an annular contact surface with the housing wall in the closed state.

The two latter casting valves can be used for reliable filling of a mold cavity with a predetermined melt portion. However, in order to compensate for material shrinkage during the solidification of the cast part, it is necessary to continue to supply melt. To this end, the previously mentioned casting valves can remain open until the shrinking process has ended which requires heating at least until it is closed and complicates an exact dosage. A second mechanism is alternatively required which fills the hollow space formed because of the shrinking process by post-feeding and post-compressing melt. The casting valve and the post-compression mechanism must be synchronized. This is, however, complicated, leads to an extensive build of the casting device, and thus increases the amount of energy required for heating.

SUMMARY

An aspect of the present invention is to improve the prior art and more specifically to provide a casting valve for a casting device which avoids the aforementioned disadvantages. An additional aspect of the present invention is to provide a die casting method for metal melts which allows for a rapid casting while simultaneously minimizing the heat supply.

In an embodiment, the present invention provides a casting valve configured to supply a melt of a casting device which includes a valve housing comprising a melt channel connection as an inlet and a valve outlet as a run-out. A melt channel is configured to be pressurizable via a casting pressure. A valve compartment is configured to receive the melt. The valve compartment is connectable via the melt channel connection with the melt channel. A closing device is configured to modify a cross-sectional surface of the valve outlet. A post-compression piston is configured to post-compress the melt after a completion of a mold filling.

BRIEF DESCRIPTION OF THE DRAWINGS

The present invention is described in greater detail below on the basis of embodiments and of the drawings in which.

DETAILED DESCRIPTION

Figure 1:
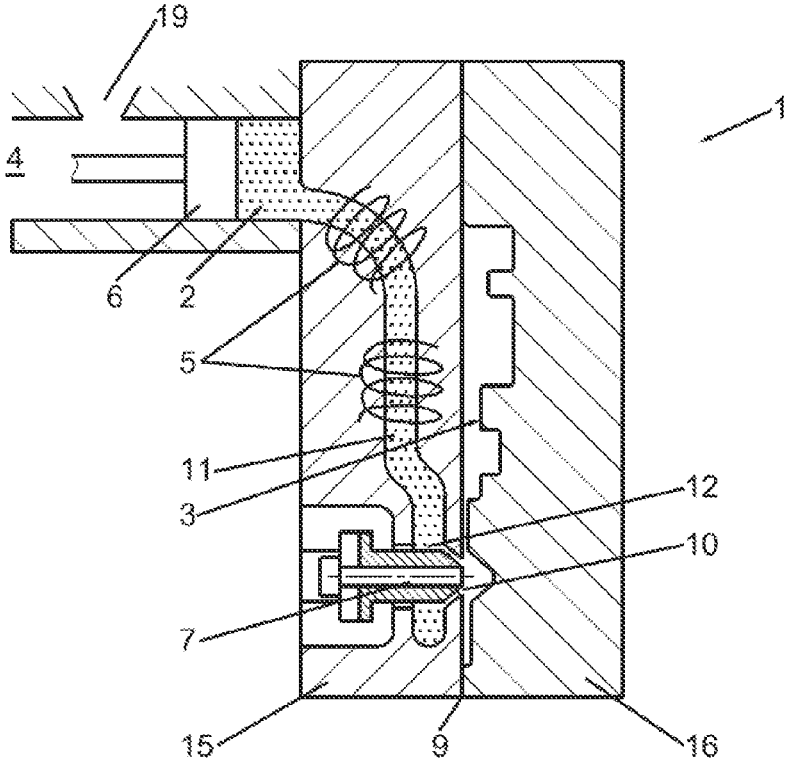
FIG. 1 shows a schematic view of a part of a casting device according to the present invention with a casting chamber and a casting valve in a longitudinal section.

The integration of the post-compression piston as a squeeze pin in the casting valve creates a space-saving arrangement which radiates relatively little heat due to its compactness. Since the melt for filling the mold cavity and the melt for post-compression come from the same valve compartment, or respectively from the valve outlet connected downstream of the valve compartment, the number of required heating means and pipes can be minimized.

The valve compartment of the casting valve is connectable to a melt reservoir or a casting chamber via the melt channel connection. If the casting valve is a part of a die casting device, the melt channel connection, the valve compartment, and the valve outlet are designed to be pressure-resistant. The valve compartment can also have several melt channel connections through which the melt can flow in.

If the valve compartment comprises several melt channel connections, it can be provided that the melt flows out again through at least one channel during casting. The valve compartment thus does not constitute the end of the melt channel; rather, melt that does not leave the casting valve through the valve outlet also flows through it during the casting process. A continuous heat supply during casting is thus provided and the heating means that is disposed in or on the casting valve can have smaller dimensions or, if applicable, can be completely dispensed with.

In an embodiment of the present invention, the casting valve can be integrated into the die casting channel so that the valve compartment is formed by a part of the melt channel that is pressurizable with a casting pressure. The valve compartment can have a storage volume that can be completely enclosed in the valve housing so that it can be heated as a hot cell located inside the casting valve. An unwanted solidification can thus be more easily avoided.

It is not necessary for the valve compartment to take up a determined volume; the casting valve can be integrated into a melt channel if the cross-sectional surface of the valve compartment corresponds to the sum of the cross-sectional surfaces of the supplying melt channel connections. In that case, it does not have a greater diameter in comparison to the melt channel, and thus does not provide an additional volume.

The casting valve can, for example, comprise a valve piston as a closing means which is axially displaceable in the direction of the valve outlet and can close it. The valve housing and the valve piston can, for example, be configured so that when the valve piston advances, the diameter of the effective cross-sectional area of the valve outlet is constantly reduced. The effective cross-sectional area of the valve outlet is that surface through which the melt flows vertically during casting. When closing the valve, the cross-sectional area of the valve outlet is reduced at least after an initial phase so that the amount of flowing melt is also reduced due to the unchanging pressure. The aperture is ultimately closed to such an extent that the melt flow is stalled, or is reduced to such an extent that the melt cools down and a continuing flow without an external heating is prevented.

The valve piston and the housing section enclosing the valve piston can, for example, form a conical valve seat. At least one of the two components valve piston or housing wall therefore comprise a bevel or a chamfer so that the cross-sectional area of the valve outlet is tapered in the direction of the valve outlet. When the valve piston approaches the bottom of the housing, the melt flow can thus occur through a ring-shaped opening that allows for a relatively laminar flow. The effect is increased if the two components, the valve piston-skirt surface and the bottom of the housing, are provided with chamfers in a sectional representation.

The chamfers do not necessarily have to be cone-shaped. The inner housing wall or the piston-skirt surface can, for example, be configured conically in sections or run in a curve in the axial direction. If the piston-skirt surface or the valve seat have a crowned configuration, concentricity errors of the valve piston can be particularly well compensated for so that the mass flow rate in the closed state is minimized despite potential clearances. The crowning advantageously also causes the formation of a linear contact between these components during closing. A jamming of the valve piston can thus be reliably prevented by the lack of surface contact and the solidifying melt material potentially remaining between the surfaces, thus preventing damage to the valve piston and the valve housing. Melt material that may have entered the valve gap can cool down due to the temperature gradient towards the surroundings and melted again for the next casting process by opening the valve.

The valve piston and the housing wall can be configured in the axial direction in a manner specific to each cast part so that the tapered cross-sectional area of the valve outlet formed by the two components is configured so that the desired mold filling velocity can be influenced by moving the valve piston. A large flow cross-sectional area, which is required for a rapid filling of the mold cavity and to avoid air pockets, can thus be provided at the beginning of casting and is reduced accordingly to the shape of the mold cavity as the degree of filling increases. If the valve piston has a variable diameter along its axial length and the valve housing is shaped accordingly, a merely temporary reduction of the flow cross-sectional area, which is broadened again before the final closing of the casting valve, is also possible.

The valve piston and the valve outlet can, for example, be disposed centrally in the valve housing. The casting valve thus has a compact structure. The valve piston drive can be disposed axially on the valve piston on the side facing away from the valve outlet and be integrated to the housing of the casting valve. If the post-compression piston is displaceable via a separate drive, the latter can also be integrated in the valve housing.

In order to prevent a reduction of the temperature of the melt and thus an undesired crystallization processes, the melt channel connection, the valve outlet, or other areas of the casting valve that are in contact with the melt can be designed so as to be heatable. Each melt section can, for example, be heated separately. An electrically operated heating has a low inertial behavior and allows for a good control or regulation of the heating output. The channel walls themselves can, for example, be heated or enclosed by coils. The valve compartment can also be heated.

In one embodiment of the invention, the valve piston also assumes the function of post-compression. The same component then forms the closing piston as well as the post-compression piston. To this end, the valve piston is designed, for example, as a circular cylinder that forms a valve seat together with a valve housing wall. The valve housing wall can first be conical and then have a tubular shape so that when the valve piston moves into the tubular section, it successively reduces the melt supply, closes the valve upon reaching the tubular section, wherein a post-compression subsequently takes place when it moves inside the tubular section.

In an embodiment of the present invention, the casting valve can, for example, have two pistons which are at least temporarily displaceable relative to each other. The first piston is formed by the valve piston with which the casting valve is closable and the second piston is designed separately from the valve piston as a post-compression piston. The two pistons can, for example, be disposed coaxially relative to each other, the post-compression piston being on the inside. The housing wall is configured so that, in this arrangement, the valve piston can travel toward the valve wall, is prevented from moving onward, and the continued movement of the post-compression piston is still possible due to its lesser diameter.

The post-compression piston can have its own piston drive for its movement relative to the valve piston. It is thereby controllable separately from the valve piston and its output can be adjusted to the post-compression. Hydraulic drives or electric spindles for example are suitable as piston drives for the post-compression piston and the valve piston. The two piston drives can also be of different types.

A particularly compact casting valve can be achieved when both pistons are displaceable by the same drive. Drive valves or other control mechanisms can provide for a displacement of only one piston or a simultaneous displacement of both pistons at a certain point in time. If a relative displacement is at least intermittently undesirable, such as during closing of the casting valve, the two pistons can also be connected to each other by way of suitable coupling means so that they can only be displaced together.

In an embodiment of the present invention, the two pistons can, for example, be coupled with each other and can only be displaced relative to each other with an elevated effort. As long as the valve piston is not in full contact, and thereby closes the valve at the valve seat, the two pistons move together. Due to the subsequently abruptly increasing force, the post-compression piston disengages from the valve piston and can then be displaced further on its own. One piston drive is sufficient in this embodiment. A complex control or regulation unit is not required in this embodiment.

Driving the piston can, for example, occur hydraulically, the piston drive being disposed on the side facing away from the valve outlet for thermal reasons. The casting valve can have isolation means transferring the pressure in order to not expose the drive unit to the high temperatures of the hot melt. The isolation means are disposed between the piston heads and the piston drives and can be formed by ceramic layers or other sufficiently solid thermal isolators.

Heat transmission can additionally or alternatively be reduced by a suitable mechanical structure. Intermediate pins with thin walls in relation to the piston diameter, which connect the piston head with the piston drive, transfer less heat as a whole and allow for the arrangement of cooling means in the intermediate spaces thus formed.

The casting valve according to the invention can, for example, be built into a die casting device for metal melts, but is also usable in other casting methods, such as continuous casting, or casting of non-metal melts.

In a casting device with a casting valve according to the invention, the amount of circulating material is reduced by the fact that filling and post-compression occur via the same casting valve. A casting device can, for example, feature the casting valve according to the present invention directly on the gate area of the cast part or on the cast part. By disposing it very near to the cast part, the proportion of sprue material and the amount of circulating material can be further reduced. Sprue masses of less than 20% of the mass of the cast part are thereby achievable, more specifically, with extensive structural parts. The gating system can at the same time be compact. The sprue material can be reused as circulating material. The casting cycle takes less time due to the fact that less sprue material needs to be melted and that the hot melt is always available in the annular duct near the mold cavity so that the cycle time is improved.

The present invention also provides a method for die casting with a die casting device and a casting valve having a valve piston comprising the following steps: providing a mold cavity that has been cleaned and prepared for a mold filling process —the casting valve being closed, opening the casting valve for casting, closing the casting valve after completion of the mold filling, removal of the cast part and post-compression during the cooling process before the removal of the cast part by means of a piston integrated in the casting valve.

The proposed method allows for filling and post-compression through the same gate so that the number of gate areas compared to the number of squeeze-pins disposed separately from the casting valve is reduced. The required finishing of the cast part is thus reduced. Due to the fact that the post-compression piston and the valve piston are disposed near each other, the occurring heat losses are reduced, and the adjustment between the phases in which the two pistons are operated is simplified.

The casting valve and the method of operation for operating the casting valve in a casting device is hereafter described in more detail based on the drawings.

FIG. 1 schematically shows a part of a casting device 1 for die casting metal melts 2 such as magnesium or aluminum melts. The casting device 1 comprises a casting chamber 4, which is fillable from a melt reservoir (not shown) by way of a melt valve 19. The melt 2 is conveyed by a hydraulically displaced horizontally advancing casting piston 6 out of a horizontally oriented casting chamber 4 and into a melt channel 11 and pressurized.

The melt channel 11 is enclosed by heating device 5 in the form of coils, which prevent a cooling of the melt 2. The melt 2 gets from the heated melt channel 11 through a melt channel connection 12 into the valve compartment 8 (FIG. 2) of the casting valve 7 and from there through the valve outlet 10 into the mold cavity 3. The mold cavity 3 itself is formed by two casting mold half shells 15, 16 and is formed in a known manner by the negative form of the die cast product to be formed increased in size by the shrinkage value. The casting mold half shells 15, 16 are separable from each other along a separation surface 9, so that the finished cast part can be removed.

Figure 2:
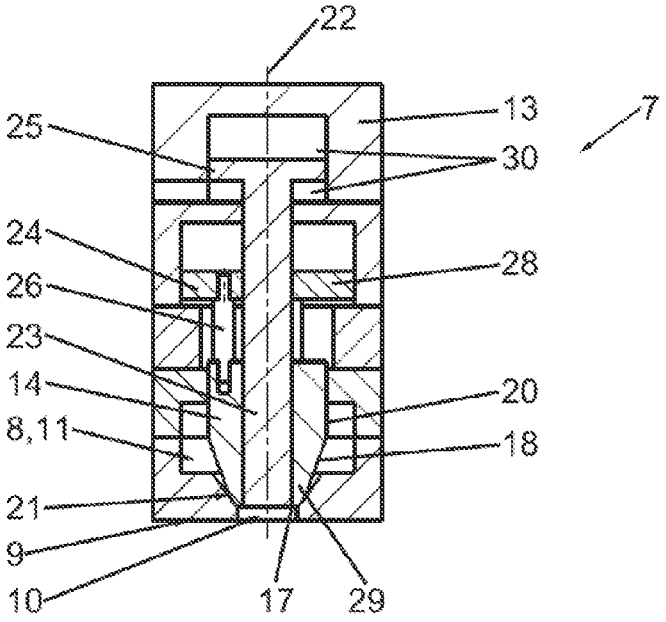
FIG. 2 shows a longitudinal section of a casting valve according to the present invention with two concentric pistons.
Figure 3:
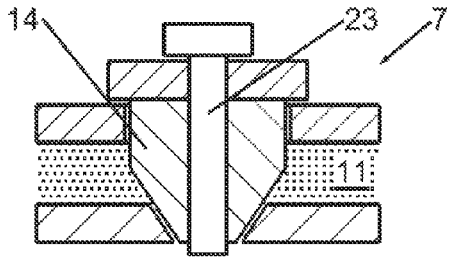
FIG. 3 shows the method according to the present invention for operating the casting valve through a schematic representation of the position of the valve piston at the moment of cleaning of the cast part mold cavity.

FIG. 2 shows a casting valve 7 with a valve housing 13 that has a valve compartment 8, which is fillable via the melt channel connection 12 and is part of the melt channel 11 itself and does not have an greater cross-section compared to the melt channel and the melt channel connection 12. The valve piston 14, with which the valve outlet 10 is closable, is centrically disposed in the valve housing 13. A crowned skin surface 18 of the valve main disc, which axially transitions into an adjacent cylinder section 20, adjoins the front side 17 of the valve piston 14. The inner wall 21 of the valve housing 13, which is adjacent to valve outlet 10, has an inclination relative to the main axis 22 of the valve that is greater than that of the skin surface 18. When closing the casting valve 7, the valve piston 14 and the inner wall 21 of the valve housing 13 thus form an annular gap and in the closed state, an annular linear contact as a valve seat due to the crowning.

The valve piston 14 is driven by a first piston drive 24, which is operated hydraulically and is disposed axially offset relative to the valve piston 14. Since the valve piston 14 is in contact with the hot melt 2, isolation 26 in the form of intermediate pins are provided as spacers, which mechanically and therefore also thermally isolate the first piston drive 24 with the piston plate 28 from the piston head 29 of the valve piston 14, but nevertheless transmit the pressure to the piston head 29.

The valve piston 14 is designed as a hollow cylinder and has a post-compression piston 23 disposed coaxially to the direction of displacement. Just as the valve piston 14, the post-compression piston 23 has a second piston drive 25, which is operable independently from the first piston drive 24. Its hydraulic chambers 30 are axially adjoined to those of the first piston drive 24.

The operation of the casting valve 1 shown in FIGS. 1 and 2 is divided into six different phases as shown in FIGS. 3-8. In the first phase shown in FIG. 3, the initial position, which is achieved after removal of the cast part of the previous casting cycle, the valve piston 14 and the post-compression piston 23 are closed and moved as far as possible in the direction of the valve outlet 10. The melt channel 11 is thus separated from the mold cavity 3, which can thus be cleaned and prepared for the next casting by way of a spraying process.

Figure 4:
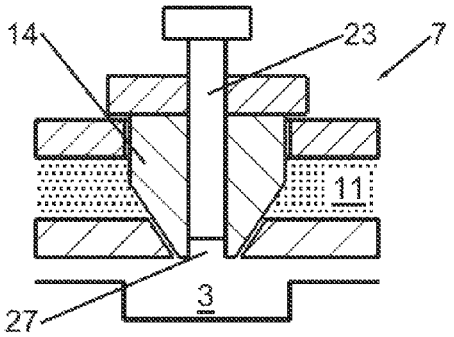
FIG. 4 shows a schematic representation of the position of the valve piston before the casting process.

Before the next casting process, the mold cavity 3 is closed so tightly that it resists the melt pressure of the subsequent die casting process (FIG. 4). In this second phase the internal post-compression piston 23 travels back to its initial position, which stands back from the valve piston 14 closing the valve outlet 10 so far that a blind hole 27 is formed between the inner walls of the valve piston 14. The depth of the blind hole corresponds approximately to the stroke of the valve piston 14.

Figure 5:
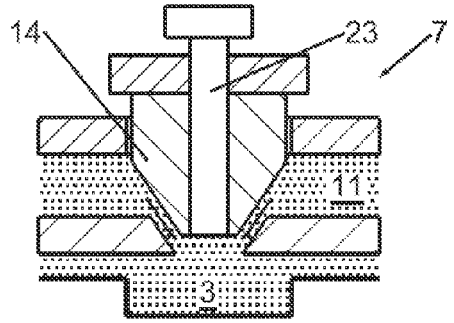
FIG. 5 shows a schematic representation of the position of the valve piston during casting.

By pulling back the valve piston 14, the third phase consisting of the actual casting process is initiated (FIG. 5). The valve piston 14 disengages from its annular valve seat and the hot melt 2 now flowing in melts the material that has potentially cooled down at that location. Due to the annular contact and a heating potentially disposed on the casting valve 7, the amount of solidified melt is so little that it is completely melted and does not or only marginally hinder an opening of the valve piston 14. The valve outlet 10 is maximally opened and the melt 2 can flow annularly between the valve piston 14 and the post-compression piston 23 and the inner wall 21 of the valve housing 13 into the mold cavity 3. The amount of melt provided for filling is pushed in by the advancing casting piston 6 via the melt channel 11.

Figure 6:
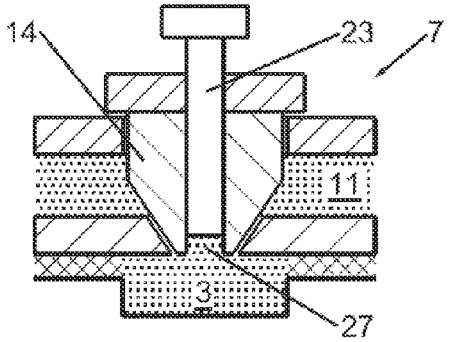
FIG. 6 shows a schematic representation of the position of the valve piston after completion of the mold filling.

After completion of the mold filling process, the casting valves 7, of which only one is shown in FIG. 1, are closed by the advancing valve piston 14 (fourth phase, FIG. 6). Due to the movement of the valve piston 14 relative to the post-compression piston 23, which does not move along, the frontal blind hole 27 is formed again and the cast part can cool down. Since the casting piston 6 of the casting chamber 4 no longer applies a melt pressure due to the closed valve piston 14, the required casting pressure is now generated by the post-compression piston 23.

Figure 7:
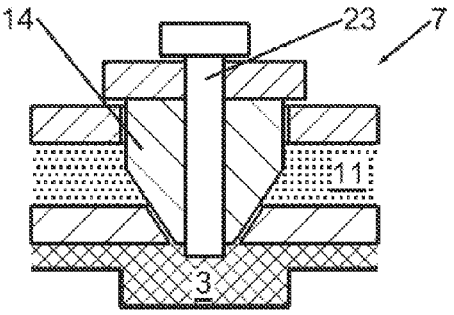
FIG. 7 shows a schematic representation of the position of the valve piston during cool-down.
Figure 8:
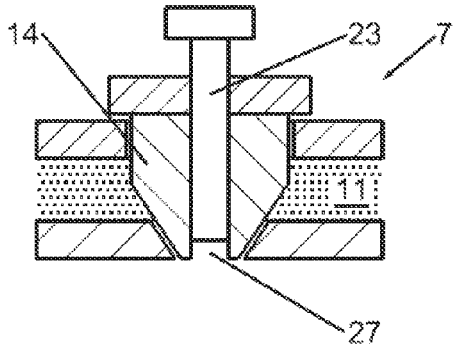
FIG. 8 shows a schematic representation of the position of the valve piston immediately before removal of the cast part.

In the fifth cooling phase, the cast part solidifies and the casting chamber 4 is prepared for a new mold filling process. During cool-down, the corresponding material shrinkage is compensated for by the fact that the post-compression piston 23 presses the melt 2 located in the blind hole 27 and in the immediately adjacent area into the mold cavity. When the amount of melt 2 required for the post-compression corresponds to the volume of the blind hole 27, the gate channel adjoining the valve outlet 10 can be particularly short or, if applicable, can be completely dispensed with. As shown in FIG. 7, in this embodiment, the post-compression piston 23 travels beyond the front side 17 of the valve piston 14 into the mold cavity 3. The cooling process can be accelerated by supplying cooling power via cooling channels.

In the last phase (FIG. 8), a retraction of the post-compression piston 23 occurs before opening the mold cavity 3 and removing the cast part; the valve piston 14 remains closed.

The present invention is not limited to embodiments described herein; reference should be had to the appended claims

LIST OF REFERENCE NUMBERS

1 casting device
2 melt
3 mold cavity
4 casting chamber
5 heating device
6 casting piston
7 casting valve
8 valve compartment
9 separation surface
10 valve outlet
11 melt channel
12 melt channel connection
13 valve housing
14 valve piston
15 casting mold half shell
16 casting mold half shell
17 front side
18 skin surface
19 melt valve
20 cylinder section
21 inner wall
22 main valve axis
23 post-compression piston
24 first piston drive
25 second piston drive
26 isolation
27 blind hole
28 piston plate
29 piston head
30 hydraulic chamber

What is claimed is:

1. A casting valve configured to supply a melt of a casting device, the casting valve comprising:

a valve housing comprising a melt channel connection as an inlet, a valve outlet as a run-out, and an inner wall;

a melt channel configured to be pressurizable via a casting pressure;

a valve compartment configured to receive the melt, the valve compartment being connectable via the melt channel connection with the melt channel;

a closing device configured to modify a cross-sectional surface of the valve outlet, the closing device being provided as a valve piston so as to form a cone-shaped valve seat together with a part of the inner wall of the valve housing;

a post-compression piston configured to post-compress the melt after a completion of a mold filling, the post-compression piston being arranged coaxially to the valve piston and being configured to be movable relative thereto;

a first piston drive configured to drive the valve piston; and a second piston drive configured to drive the post-compression piston.

2. The casting valve as recited in claim 1, wherein, the inner wall of the valve housing comprises a tapered part with a conical configuration, and the valve piston comprises a crowned piston skirt-surface configured to form a linear contact with the inner wall of the valve housing during a closing.

3. The casting valve as recited in claim 1, wherein at least one of the first piston drive and the second piston drive are configured as a hydraulic drive.

4. The casting valve as recited in claim 1, wherein the casting valve further comprises a heating device configured to heat the valve compartment.

5. The casting valve as recited in claim 1, wherein the casting valve further comprises isolation configured to thermally isolate the valve piston from the first piston drive.

6. A casting device for die casting, the casting device comprising:

a mold cavity; and a casting valve as recited in claim 1, wherein the casting valve is arranged directly on a gate area or directly on the mold cavity.

* * * * *